United States Patent [19]

Ross

[11] 4,161,330

[45] Jul. 17, 1979

[54] INVENTORY COMPARISON SYSTEM

[75] Inventor: Donald E. Ross, Centerville, Ohio

[73] Assignee: Dayco Corporation, Dayton, Ohio

[21] Appl. No.: 949,609

[22] Filed: Oct. 10, 1978

[51] Int. Cl.[2] ..... B42D 15/00

[52] U.S. Cl. ..... 283/55; 283/1 R

[58] Field of Search ..... 35/24 R, 24 A; 40/489, 40/490; 283/1 R, 55, 60 R

[56] References Cited

U.S. PATENT DOCUMENTS

| | | | |
|---|---|---|---|
| 2,157,036 | 5/1939 | Torkelson | 283/1 R |
| 3,123,385 | 3/1964 | Bromwell | 283/55 |
| 3,406,467 | 10/1968 | Davis | 35/24 R |

*Primary Examiner*—Gerald A. Dost

*Attorney, Agent, or Firm*—Reuben Wolk

[57] ABSTRACT

An apparatus for and method of comparing an inventory of a competitor's products with a supplier's suggested inventory are provided utilizing a competitor's part numbers sheet having a first arrangement of the competitor's part numbers thereon with a vacancy adjacent each part number for marking the quantity of each number to define the inventory of competitor's products and a supplier's part number sheet is provided having a second arrangement of the supplier's part numbers thereon which is identical to the first arrangement with the supplier's sheet having an opening therein adjacent its numbers whereupon the supplier's sheet is aligned over the competitor's sheet so that the supplier's sheet hides the first arrangement of part numbers and each quantity of competitor's part numbers is viewable through the opening opposite a corresponding supplier's part number, whereby each supplier's part number and its viewable quantity comprise the supplier's suggested inventory.

20 Claims, 7 Drawing Figures

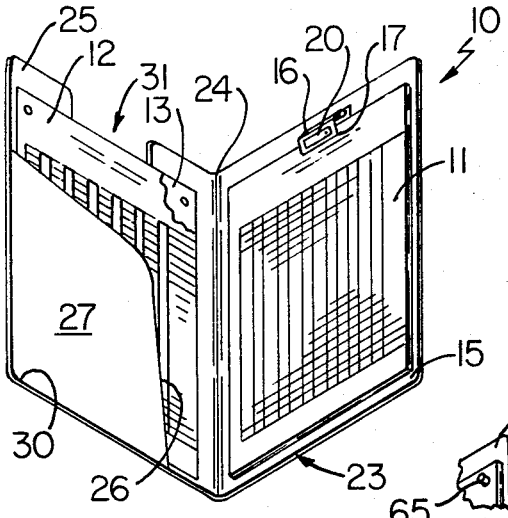
FIG.1
FIG.1A
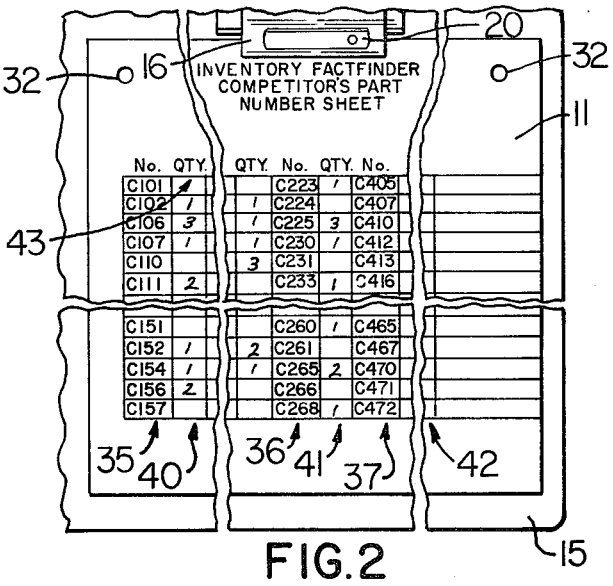
FIG.2
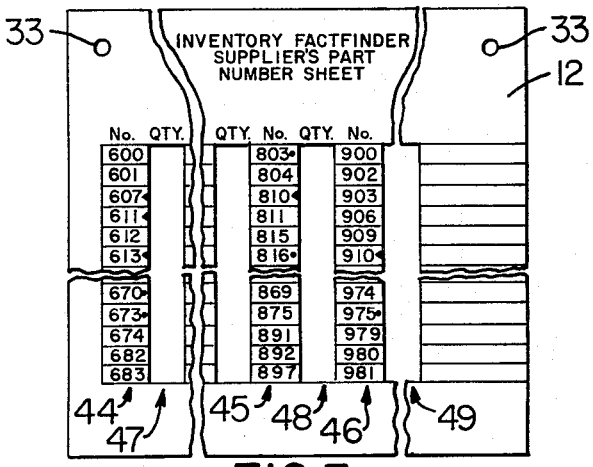
FIG.3
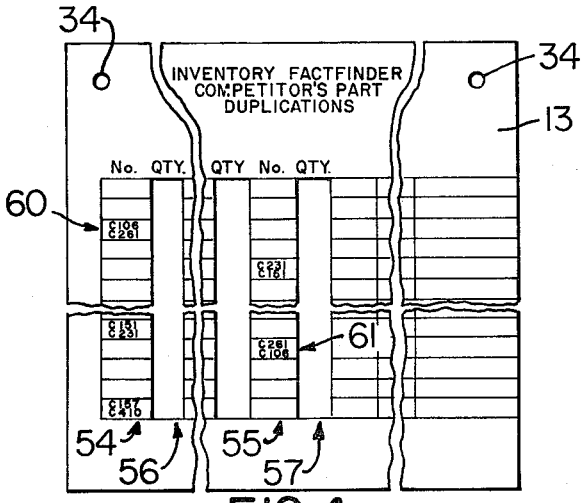
FIG.4
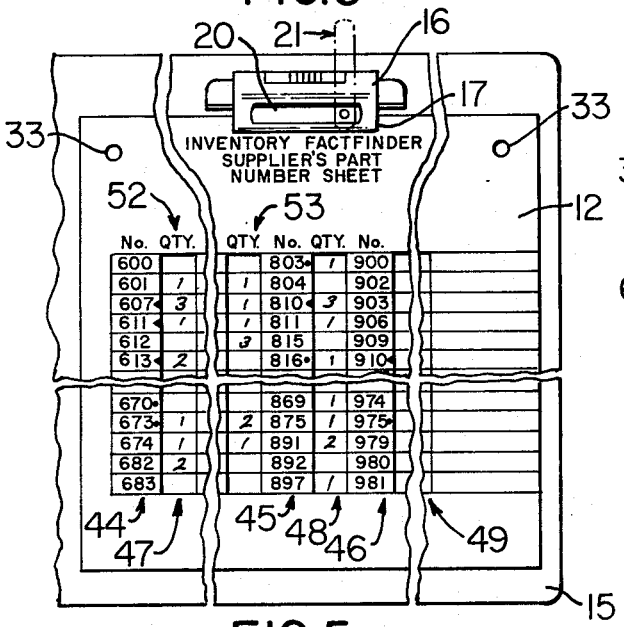
FIG.5
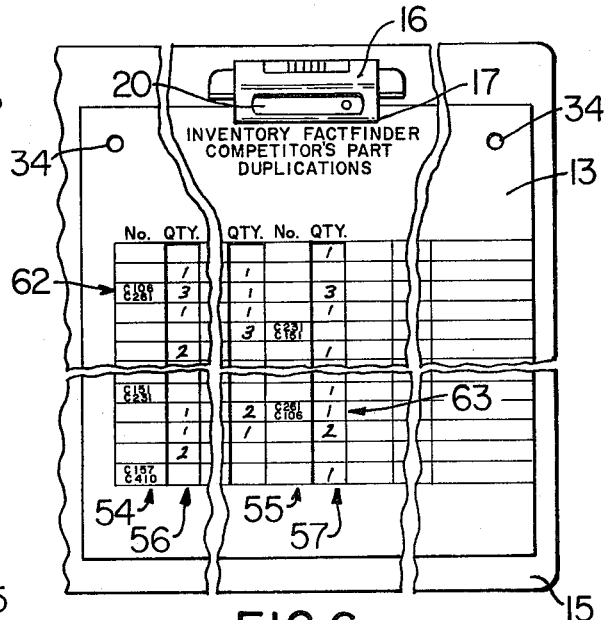
FIG.6

INVENTORY COMPARISON SYSTEM

BACKGROUND OF THE INVENTION

1. Field of the Invention

This invention relates to an apparatus for and method of comparing an inventory of a competitor's products with a supplier's suggested inventory of products.

2. Prior Art Statement

It is known in the art that a supplier wishing to sell his products to a customer to replace a competitor's products will have available a list or sheet of the competitor's product part numbers and will have another list or sheet of his own product part numbers which can be substituted therefor. These lists are then laboriously compared, item for item, so that the supplier may suggest an inventory of his suggested parts for the inventory of a competitor's products.

Suppliers attempting to sell replacement parts, such as polymeric endless power transmission belts, which are popularly referred to as V-belts, to customers in the automobile industry have found that a supplier calling on a customer in his facility and making an efficient on-the-spot comparison of a competitor's parts in the customer's inventory with his own suggested parts often makes a favorable impression on the customer and is usually given an opportunity to quote prices for his suggested parts.

SUMMARY

It is a feature of this invention to provide an improved apparatus for and method of comparing an inventory of a competitor's products with a supplier's suggested inventory enabling such comparison to be made in an efficient manner.

Another feature of this invention is to provide an improved apparatus for and method of determining duplicate part numbers of a competitor's products in inventory rapidly and accurately for the purpose of recommending a smaller number of the supplier's items or part numbers which will still satisfy the customer's inventory requirements.

Another feature of this invention is to provide an apparatus for and method of comparing an inventory of a competitor's products with a supplier's suggested inventory wherein the supplier's suggested inventory offers a customer the benefit of choosing products having industry-wide popularity.

Therefore, it is an object of this invention to provide an improved apparatus for and method of comparing an inventory of a competitor's products with a supplier's suggested inventory having one or more of the novel features set forth above or hereinafter shown or described.

Other details, features, uses, objects, and advantages of this invention will become apparent from the embodiments thereof presented in the following specification, claims, and drawing.

BRIEF DESCRIPTION OF THE DRAWING

The accompanying drawing shows a present preferred embodiment of this invention, in which FIG. 1 is a perspective view illustrating a booklike cover structure having integral sheet supporting means comprising the apparatus and used in the method of this invention;

FIG. 1A is a fragmentary perspective view of a top right corner of a modification of the sheet supporting means of the cover structure of FIG. 1;

FIG. 2 is a plan view with parts broken away illustrating a competitor's part numbers sheet of this invention supported on the sheet supporting means of FIG. 1 and also showing available quantities of an exemplary inventory marked thereon;

FIG. 3 is a plan view with parts broken away of a typical supplier's part numbers sheet of this invention;

FIG. 4 is a plan view similar to FIG. 3 of a competitor's duplicated part numbers sheet;

FIG. 5 is a view similar to FIG. 2 illustrating the supplier's part numbers sheet of FIG. 3 disposed over the marked sheet of competitor's part numbers; and FIG. 6 is a view similar to FIG. 5 illustrating the competitor's duplicated part numbers disposed over the marked sheet of competitor's part numbers.

DESCRIPTION OF ILLUSTRATED EMBODIMENT

Reference is now made to FIG. 1 of the drawing which illustrates one exemplary embodiment of the apparatus and method of this invention which is designated generally by the reference numeral 10. The apparatus and method 10 provides a quick and easy comparison of an inventory of a competitor's products with a supplier's suggested inventory; and, the apparatus and method enables quick and easy identification of the competitor's duplicated part numbers in a users or customer's particular inventory for the purpose of suggesting to such customer a lesser number of the supplier's part numbers that can satisfy the customer's needs and at substantial economies.

The apparatus 10 comprises a competitor's part numbers sheet 11, as shown in FIG. 2; a supplier's part numbers sheet 12, as shown in FIG. 3; and a competitor's part duplications sheet 13, as shown in FIG. 4. These sheets and the manner in which they cooperate with the apparatus and method of this invention will be described in detail subsequently.

The apparatus 10 also comprises means supporting and aligning the various previously mentioned sheets 11, 12, and 13 and such means in this example is in the form of a substantially planar support member 15 which has a clamp device or clamp 16 for holding selected sheets in aligned relation. The clamp 16 may be considered a part of the supporting and aligning means and such clamp may be the typical type of clamp found on a common so-called clip board which has a clamping portion 17 which is urged by a spring (not shown) toward and against member 15 and has a pivotally mounted blade 20 which is engaged and pivoted to an actuating position shown by dotted lines 21 in FIG. 5 and such actuating position is substantially transverse its stored position, shown by solid lines. Upon pressing the blade 20, with such blade in its actuating position, toward the plane of the paper the previously mentioned spring is over-ridden and the clamping portion 17 lifted away from the support member 15 to enable insertion and removal of sheets as desired; and, upon releasing the blade 20 the clamping portion 17 is returned by its spring against the member 15 or against a sheet sandwiched between portion 17 and member 15.

The support member 15 may be of any suitable construction; however, such member preferably defines the back, also designated by the reference numeral 15, of a book-like cover structure 23 as shown in FIG. 1. The cover structure 23 has a substantially rectangular spacer portion 24 which has the back 15 foldably or hingedly fastened along one side edge thereof and has a top cover or top member 25 hingedly fastened to an opposite side edge portion thereof with the portion 24 defining the thickness of the book-like structure which has the usual wedge-shaped appearance once the top member 25 is closed or folded against the back 15 and with the book-like cover structure 23 empty of sheets, or the like.

The top member 25 has an integral pocket 26 therein defined by a roughly rectangular sheet-like member or portion 27 which is smaller in dimension than the member 25 and is suitably fixed along an L-shaped corner 30 thereof to the member 25. The pocket 26 is particularly adapted to contain sheets employed in the apparatus and method of this invention.

The top member 21 also has a roughly rectangular cutout 31 defined in the top central portion (as viewed in FIG. 1) thereof, and the cutout 31 serves the dual-purpose of enabling easy grasping of sheets disposed in the pocket 26 while also allowing the top member or cover 21 to be folded against member 15 with the clamp 16 passing through the cutout 31.

The sheet 11 has what will be referred to as first sheet aligning means shown as a pair of circular marks each designated by the same reference numeral 32 in top adjacent corners thereof and the circular marks or circles 32 are particularly adapted to be used in aligning sheets 12 and 13 over sheet 11. Similarly, the sheet 12 has what will be referred to as second sheet aligning means shown as a pair of punched holes 33 in top adjacent corners thereof; and, sheet 13 has third sheet aligning means in its top adjacent corners in the form of circular punched holes 34 with the holes 33–34 being of equal diameter which is slightly larger than the diameter of the circular marks 32. The holes 33–34 of sheets 12-13 and the location of the marking or printing on such sheets are correlated with the circular marks 32 and the location of the marking or printing on the sheet 11 so that once each sheet 12 or 13 has its respective holes 33–34 aligned over circular marks 32 so they are visible therethrough, the sheets 11, 12, and 13 as taught by this invention cooperate as will be explained in more detail subsequently.

The apparatus 10 comprises the previously mentioned competitor's part numbers sheet 11 and such sheet has a first arrangement of a plurality of a particular competitor's parts numbers thereon and in this example such first arrangement comprises a plurality of vertical columns in which, for convenience, three columns 35, 36, and 37 of numbers are illustrated in FIG. 2; and, it will be seen that a vacancy is provided on the sheet 11 adjacent each part number for marking the available quantity of each part number to thereby define the inventory of a competitor's products in a particular customer's inventory. Accordingly, vacancies 40, 41, and 42 are provided on sheet 11 adjacent their respective columns 35, 36, and 37 and each vacancy adjacent a particular part number may be outlined by a rectangular marking as shown typically at 43.

The sheet 11 is easily supported on the support member and clamped in position by the clamp 16 for marking thereon the available quantity of the competitor's part numbers in the customer's inventory and as indicated by the quantities marked for certain numbers on sheet 11 shown in FIG. 2. For example, competitor's part number C106 has a quantity of three in the customer's inventory as marked in the vacancy opposite number C106 while competitor's part number C260 has a quantity of one as marked in the vacancy 41 opposite part number C260.

The apparatus 10 also comprises the previously mentioned supplier's part numbers sheet 12 as illustrated in FIG. 3 of the drawing. The supplier's part numbers sheet has a second arrangement of part numbers in the form of a plurality of columns which correspond in number, size, and arrangement to the plurality of columns on sheet 11 and each column has a supplier's part number therein at each position that a supplier's part number is on sheet 11. In this example a plurality of only three columns 44, 45, and 46 are illustrated which correspond to columns 35, 36, and 37 respectively of sheet 11 and as predetermined by the supplier in making up sheets 11 and 12 the supplier's products identified by the part numbers are completely functionally interchangeable with the products identified by the part numbers on the competitor's sheet 11.

The supplier's part numbers sheet 12 has opening means therein shown in this example as a plurality of openings in the form of rectangular cutout slots corresponding in number to the number of columns of parts numbers in the supplier's sheet 12 and in this example of a plurality of substantially identical slots 47, 48, and 49 are provided in sheet 12 adjacent their respective columns 44, 45, and 46 of part numbers.

The sheet 12 is particularly adapted to be disposed in aligned relation over a previously marked competitor's parts numbers sheet 11, as shown in FIG. 5, for example, such that the supplier's sheet 12 blocks from view the first arrangement of part numbers, i.e., blocks from view columns 35, 36, and 37 of part numbers on the competitor's part numbers sheet. However, each quantity of a competitor's part number in a customers inventory being analysed is viewable through the opening slot opposite a corresponding supplier's part number as shown at 52 and 53, for example. With this construction and arrangement of sheets, each supplier's part number and its viewable quantity comprises the supplier's suggested inventory for the competitor's products. Accordingly, a new suggested inventory consisting of supplier's parts may be suggested with accuracy and speed inasmuch as all that is required after alignment of sheets 11 and 12 is a viewing of applicable quantities marked opposite the predetermined appropriate supplier's part numbers.

The supplier has a usage code or scale for each of his product part numbers in a particular class. In the case of V-belts each belt part number may be ranked within one of four ranges 1–50, 51–80, 80–100, and above 100. Obviously, the number of ranges for a product may be changed, as desired, and belts in one range may move up or down into another range depending on usage popularity.

In order to be identified according to a usage code, the part numbers on the supplier's part numbers sheet 12 are marked with suitable identifying means to indicate their industry-wide usage. For example, supplier's numbers 607, 611, 613, 810, and 910 on sheet 12 have a wedge or triangular identification adjacent thereto and such triangular identification indicates that these particular part numbers have maximum industry-wide usage ranking above 100 according to the supplier's usage code or scale. It will also be noted that part numbers 670, 673, 803, 816, and 975 have a circular dot adjacent thereto indicating a ranking in the range of 51–80. These rankings as to industry-wide usage popularity enable a customer to have the benefit of ordering proven products and in many instances the more widely used product can be purchased at a lower price if purchased at the time of its popularity. The supplier changes his rankings and hence his identifying means on sheet 12 from time to time as conditions change by providing dated revisions of such sheet.

In this disclosure of the invention the belts in a plurality of only two ranges have been indicated on sheet 12; however, it is to be understood that additional markings or symbols may be provided to indicate other applicable ranges.

It will also be appreciated that the ranking may be achieved by printing or otherwise providing the part numbers on sheet 12 in different colors which are in contrast with the sheet itself and with each other. For example, sheet 12 of this example may be made of a white material such as paper and numbers 607, 611, 613, 810, and 910 printed in black to indicate their ranking instead of using triangular marks alongside same. Similarly, instead of using circular dots along part numbers 670, 673, 803, 816, and 975 to indicate their ranking such numbers could be printed in a contrasting color, such as blue, for example. Obviously, any combination of desired colors may be employed with a different color for each desired range.

The apparatus 10 further comprises the previously mentioned duplicated part numbers sheet 13 and this reference to duplicated part numbers means that a plurality of parts with different numbers may be used interchangeably to perform the same function. The sheet 13 is shown in FIG. 4 and has a third arrangement of the competitor's part numbers thereon. This third arrangement has each duplicated part number of each particular number listed with its particular number at the location of its particular number on the sheet. The third arrangement in this example comprises a plurality of vertical columns of numbers with two of such columns 54 and 55 being illustrated. The sheet 13 also has opening means therein, shown in this example as a plurality of rectangular slots or openings 56 and 57 associated with their respective columns 54 and 55 of numbers. The sheet 13 is particularly adapted to be disposed in aligned relation over the sheet 11 as shown in FIG. 6 so that the sheet 13 blocks from view the first arrangement of part numbers on sheet 11 and enables easy determination of the total quantity of duplicated competitor's part numbers with each quantity of a competitor's part numbers being viewable through an associated opening opposite the location of each particular competitor's part number for determination of a corresponding reduced number of a supplier's part number.

In using sheet 13 it will be seen that number C106, for example, has number C261, its duplicate number, disposed therebeneath at the usual location of number C106 on the competitor's part number sheet as shown at 60 for example, FIG. 4. It will be noted that C106 is the third number in column 54 of sheet 13 and the third number in column 35 of sheet 11. Similarly, number C261, at its usual location in both sheets 11 and 13, has its duplicate C106 disposed therebeneath on sheet 13 as shown at 61.

The sheet 13 is disposed over sheet 11 while supporting both sheets on support 15 (FIG. 6) and as explained earlier this enables determination of the total quantity of the competitor's duplicated part numbers in the customer's inventory being analysed by a supplier. Referring again to part numbers C106 and C261 it is seen in FIG. 6 that three parts of C106 are in inventory as shown at 62 and only one part of C261 as shown at 63. However, C106 and C261 are classified as duplicate parts because they are functionally interchangeable as previously explained. Accordingly, a total of four parts are available in inventory to satisfy the requirements of part numbers C106 and C261. The supplier may use this information to suggest purchase of his highly ranked part number 607 in lesser total quantity. However, regardless of quantity purchased only part number 607 need be kept in inventory and the supplier can probably provide part 607 at a lesser price because of its popularity or usage ranking.

In this disclosure of the invention sheet 11 is provided with circular marks 32 which are used for the purpose of aligning thereover circular openings 33 and 34 of sheets 12 and 13 respectively. However, it is to be understood that the means for supporting and aligning the various sheets may comprise a pair of pins fixed to member 15 with a typical pin 65 being shown on corner of a modified number 15 in FIG. 1A. Another pin 65 (not shown) is provided on the opposite corner of such modified member.

In this disclosure of the invention the sheet 11 is identified as a competitor's part numbers sheet and it will be appreciated that a similar sheet will be provided for each of a supplier's competitors in a particular field. The only change for each different competitor would be the provision of the sheet with the appropriate part numbers for each different competitor.

The apparatus and method of this invention is particularly useful in selling replacement V-belts to automobile industry customers such as parts distributors, retail stores automobile servicing facilities, and the like. However, it will be appreciated that the method and apparatus disclosed herein is fully applicable to other industries and is fully applicable for selling replacement parts of all types. For example, common replaceable components such as cooling-heating system hose, filters, and similar components may be sold using the teachings of this disclosure.

The sheets 11, 12, and 13 may be made of any suitable material employed in the art. Preferably such sheets are made of white paper with suitable printing thereon to indicate the various part numbers.

The supplier's part number sheet in this disclosure indicates a particular usage for certain part numbers; however, it is to be understood that such sheets are updated periodically to reflect the latest usage and the updated sheets are sent to a suppliers salesman with appropriate instructions to destroy the previous sheets.

While present exemplary embodiments of this invention, and methods of practicing the same, have been illustrated and described, it will be recognized that this invention may be otherwise variously embodied and practiced within the scope of the following claims.

What is claimed is:

1. In an apparatus for comparing an inventory of a competitor's products with a supplier's suggested inventory, the improvement comprising, a competitor's part numbers sheet having a first arrangement of said competitor's part numbers thereon with a vacancy on said sheet adjacent each part number for marking the available quantity of each part number to define said inventory of competitor's products, a supplier's part numbers sheet having a second arrangement of said supplier's part numbers thereon which is identical to said first arrangement, opening means in said supplier's sheet adjacent the part numbers thereon, first sheet aligning means comprising said competitor's sheet and second sheet aligning means comprising said supplier's sheet, and means supporting and aligning said competitor's sheet and said supplier's sheet in aligned relation employing said first and second sheet aligning means so that said supplier's sheet blocks from view said first arrangement of part numbers and each quantity of a competitor's part number is viewable through said opening means opposite a corresponding supplier's part number, each supplier's part number and its viewable quantity comprising said supplier's suggested inventory for said inventory of said competitor's products.

2. In an apparatus as set forth in claim 1 the further improvement in which said supplier's part numbers on said supplier's part numbers sheet are identified as to industry-wide popularity enabling use of said popularity for sales purposes.

3. In an apparatus as set forth in claim 1 the further improvement in which said opening means is defined by at least one cut-out in said supplier's sheet.

4. In an apparatus as set forth in claim 1 the further improvement in which said first arrangement of said competitor's part numbers comprises a plurality of vertical columns of competitor's part numbers, said second arrangement of said supplier's part numbers comprises a corresponding plurality of vertical columns of supplier's part numbers, and said opening means in said supplier's sheet comprises a plurality of rectangular slots in said sheet each provided adjacent an associated vertical column of part numbers.

5. In an apparatus as set forth in claim 1 the further improvement comprising a competitor's duplicated part numbers sheet having a third arrangement of said competitor's part numbers thereon, said third arrangement having each duplicated number of each particular number listed with its particular number at the location of its particular number on said sheet, opening means in said competitor's duplicated part numbers sheet adjacent the part numbers thereon, third sheet aligning means comprising said competitor's duplicated part numbers sheet, said supporting and aligning means employing said third sheet aligning means to dispose said competitor's duplicated part numbers sheet and competitor's part numbers sheet in aligned relation so that said competitor's duplicated part numbers sheet blocks from view said first arrangement of part numbers enabling easy determination of the total duplicated competitor's part numbers and each quantity of a competitor's part number is viewable through said opening means opposite the location of each particular competitor's part number for determination of a corresponding reduced number of a supplier's part number.

6. In an apparatus as set forth in claim 1 the further improvement in which said supporting and aligning means comprises a substantially planar support member and a clamp for holding said sheets in aligned relation.

7. In an apparatus as set forth in claim 5 the further improvement in which said first sheet aligning means comprises a pair of marks on said sheet and said second and third sheet aligning means comprise a pair of holes in each respective sheet for disposal over the pair of marks of said first sheet for alignment purposes.

8. In an apparatus as set forth in claim 6 the further improvement in which said supporting and aligning means further comprises a pair of spaced apart locating pins attached to and extending from said planar support member, and said first, second, and third sheet aligning means comprise a pair of holes in each respective sheet, said pins being adapted to be inserted through said openings in each sheet for precise alignment of said sheets.

9. In an apparatus as set forth in claim 6 the further improvement in which said support member defines the back of a book-like cover structure and further comprising a spacer portion having said back hingedly fastened to one side edge thereof and a top member hingedly fastened to an opposite side edge thereof, said spacer portion defining the thickness of said book-like structure.

10. In an apparatus as set forth in claim 1 the further improvement in which said supplier's part numbers on said supplier's part number sheet are marked with identifying means to indicate their industry-wide usage.

11. In an apparatus as set forth in claim 10 the further improvement in which said identifying means comprises different identifying marks which are keyed to a special code.

12. In an apparatus as set forth in claim 10 the further improvement in which said identifying means comprises coloring said part numbers in different colors keyed to a special code.

13. In a method of comparing an inventory of a competitor's products with a supplier's suggested product inventory, the improvement comprising the steps of, providing a first arrangement of a plurality of said competitor's part numbers on a competitor's part number sheet with a vacancy on said competitor's part number sheet adjacent each part number for marking the available quantity of each part number to define said inventory of competitor's products, providing a second arrangement of a corresponding plurality of said supplier's part numbers on a supplier's part number sheet with said second arrangement being identical to said first arrangement, forming opening means in said supplier's sheet adjacent the numbers thereon, and disposing said supplier's sheet in aligned relation over said competitor's sheet so that said supplier's sheet blocks from view said first arrangement of part numbers and each quantity of competitor's part numbers is viewble through said opening means opposite a corresponding supplier's part number, each supplier's part number and its viewable quantity comprising said supplier's suggested inventory for said inventory of said competitor's products.

14. In a method as set forth in claim 13 the further improvement comprising the step of identifying said supplier's part numbers of said supplier's part number sheet to indicate industry wide popularity thereof to enable use of said popularity for sales purposes.

15. In a method as set forth in claim 14 the further improvement in which said identifying step comprises identifying said supplier's part numbers with different identifying marks keyed to a special code.

16. In a method as set forth in claim 14 the further improvement in which said identifying step comprises identifying said supplier's part numbers by coloring same in different colors keyed to a special code.

17. In a method as set forth in claim 13 the further improvement comprising the steps of providing a third arrangement of a competitor×s duplicated part numbers on a competitor's duplicated part numbers sheet, said third arrangement having each duplicated number of each particular number listed with its particular number at the location of its particular number on said sheet, forming opening means in said competitor's duplicated part numbers sheet adjacent the part numbers thereon, and disposing said competitor's duplicated part numbers sheet and competitor's part numbers sheet in aligned relation so that said competitor's duplicated part numbers sheet blocks from view said first arrangement of part numbers enabling easy determination of the total duplicated competitor's part numbers and each quantity of a competitor's part number is viewable through said opening means opposite the location of each particular competitor's part number for determination of a corresponding reduced number of a supplier's part number.

18. In a method as set forth in claim 17 the further improvement comprising the steps of providing supporting and aligning means to facilitate each disposing step.

19. In a method as set forth in claim 18 the further improvement in which said step of providing supporting and aligning means comprises providing a substantially planar support for said sheets.

20. In a method as set forth in claim 18 the further improvement in which said step of providing supporting and aligning means comprises providing a substantially planar support for said sheets having a pair of locating pins extending from adjacent top corners thereof and cutting a pair of holes in each of said sheets at corresponding adjacent top corners thereof, said pins being adapted to be inserted through said openings in each sheet for precise alignment during said disposing steps.

* * * * *